United States Patent [19]

Wall

[11] 4,259,619

[45] Mar. 31, 1981

[54] THREE-WAY LIGHT DIMMER SWITCH

[75] Inventor: Bill R. Wall, Bulverde, Tex.

[73] Assignee: Power Controls Corporation, San Antonio, Tex.

[21] Appl. No.: 797,528

[22] Filed: May 16, 1977 (Under 37 CFR 1.47)

Related U.S. Application Data

[63] Continuation-in-part of Ser. No. 647,640, Jan. 8, 1976, which is a continuation-in-part of Ser. No. 579,255, May 20, 1975, Pat. No. 3,990,033.

[51] Int. Cl.[3] ..... H05B 37/02; H05B 39/06

[52] U.S. Cl. ..... 315/361; 307/115; 315/199; 315/299; 315/362

[58] Field of Search ..... 315/194, 199, 291, 299, 315/361, 362; 307/98, 113, 115, 157; 200/5 R

[56] References Cited

U.S. PATENT DOCUMENTS

| | | | |
|---|---|---|---|
| 3,011,095 | 11/1961 | Kriechbaum | 315/361 X |
| 3,037,146 | 5/1962 | Slater | 315/209 R |
| 3,534,224 | 10/1970 | Skirpan et al. | 315/296 |
| 3,846,671 | 11/1974 | Johnson | 315/361 X |
| 3,868,546 | 2/1975 | Gilbreath et al. | 315/299 X |
| 3,893,002 | 7/1975 | Woodnutt | 315/291 |

*Primary Examiner*—Eugene R. La Roche
*Attorney, Agent, or Firm*—Gunn & Lee

[57] ABSTRACT

A three-way light dimmer switch is shown wherein the brightness of a lamp or lamps is controlled by independent light dimmer switches with each dimmer switch having its own light dimmer circuit. Each of the light dimmer switches is vertically actuated with one end of the vertical movement turning the lamp or lamps ON, and the other end of the vertical movement turning the lamp or lamps OFF. Between the limits of vertical movement, either of the light dimmer switches may vary the voltage potential received by the lamp to thereby adjust the brightness of the lamp.

4 Claims, 3 Drawing Figures

THREE-WAY LIGHT DIMMER SWITCH

This patent application is a continuation-in-part of co-pending U.S. Pat. application Ser. No. 647,640 filed on Jan. 8, 1976, which is a further continuation-in-part of U.S. Pat. application Ser. No. 579,255 filed on May 20, 1975 and subsequently issued on Nov. 2, 1976 as U.S. Pat. No. 3,990,033.

BACKGROUND OF THE INVENTION

This invention relates to a light dimmer switch and, more particularly, to a three-way light dimmer switch combination utilizing independent light dimmer circuits for controlling the brightness of a lamp.

BRIEF DESCRIPTION OF THE PRIOR ART

Many different types of circuits have been designed in the past for controlling the brightness of lamps or lighting systems. Initially, variable resistors were used with a portion of the voltage applied to the lighting system being dissipated in the resistor to reduce the illumination from the lights. Power not dissipated in the lights was dissipated in the variable resistor as the illumination of the lighting system changed. While this means of dimming was feasible when the cost of energy was less, the variable resistance dimming networks are no longer feasible because of today's high cost of energy.

As solid state electronics developed, many different types of switching arrangements were devised to provide dimming capabilities in various lighting systems. Initially, transistor switching devices were used. The transistors would conduct only during a portion of the cycle depending upon the base voltage applied to the transistor. As the length of time the base voltage was above the amount necessary for conduction of the transistor was varied, the period of conduction of the transistor was also varied.

With the further development of silicon control rectifiers (SCR), the conduction time through the SCR could be varied by varying the voltage applied to the gate. This would allow the lamp or other lighting system to conduct for a portion of a half-cycle, or a portion of the full cycle, if the AC voltage was fully rectified. Conduction would depend upon the gate voltage applied to the silicon control rectifier. With the further development of thyristors (silicon control rectifiers and triacs being a type of thyristors), a triac will conduct during either half-cycle of standard AC line voltage depending upon the gate voltage applied to the triac. Diacs have been in common use for triggering the conduction of triacs as can be seen in SCR Manual, 5th Edition, 1972, General Electric Company, page 192.

Even with the tremendous advances in light dimming circuits to allow the dimming of lamps without excessive power waste, none of the prior art shows a three-way light dimming switch combination with independent dimmer circuits located in either switch and with either switch having light dimming capabilities. For example, Hunt Electronics Company has done considerable work with light dimming systems, but even in their issued patents (U.S. Pat. No. 3,846,671 to Johnson and U.S. Pat. No. 3,868,546 to Gilbreath) only a single light dimming circuit was used with remote controls for two independent switches controlling the single light dimming circuit.

Skirpan (U.S. Pat. No. 3,534,224) shows a fairly complex electronic apparatus that has two separate light dimming circuits with their respective loads being controlled by one supervisory control. The purpose of Skirpan was to provide for simultaneous increase in brightness of one load and decrease in brightness of another load. A typical example of the proposed use of Skirpan was to decrease the intensity of theater lights while simultaneously increasing the intensity of the stage lights, or vice versa.

Another alternative dimming circuit is shown in Woodnutt (U.S. Pat. No. 3,893,002) wherein the brightness of the lighting system depends upon the charge of an RC circuit that has a very long time constant.

SUMMARY OF THE INVENTION

It is an object of the present invention to provide a three-way light dimmer switch.

It is still another object of the present invention to provide a first light dimmer switch that can be combined with a second light dimmer switch to give three-way light dimming capabilities. Each of the light dimmer switches has a common lead connecting to a contactor arm. As a vertically actuated lever arm of either of the switches is moved from one limit of its vertical position, a contact is broken; and as the vertically actuated lever arm moves to the opposite limit of its vertical movement, another contact is broken. Interconnected between contacts for the contactor arm is a dimmer circuit for controlling the brightness of the lamp or lighting system. By proper connection of the contacts for the contactor arms for two light dimmer switches, and by using the common lead which connects to the actuator arm as the input and output, the intensity of a lamp or other lighting system can be varied from either light dimmer switch. By proper interconnection between the two light dimmer switches, either of the following capabilities may be provided. (1) When either light dimmer switch is in the OFF position, the opposite light dimmer switch will brighten, dim or turn the lamp full ON; and when either light dimmer switch is in the DIM or FULL position, the opposite light dimmer switch will turn the lamp ON and OFF. (2) When either light dimmer switch is in the FULL position, the opposite light dimmer switch will brighten, dim or turn OFF the lamp; and when either light dimmer switch is in the DIM or OFF position, the opposite light dimmer switch will turn the lamp ON and OFF.

DESCRIPTION OF THE PREFERRED EMBODIMENT

Figure 1:
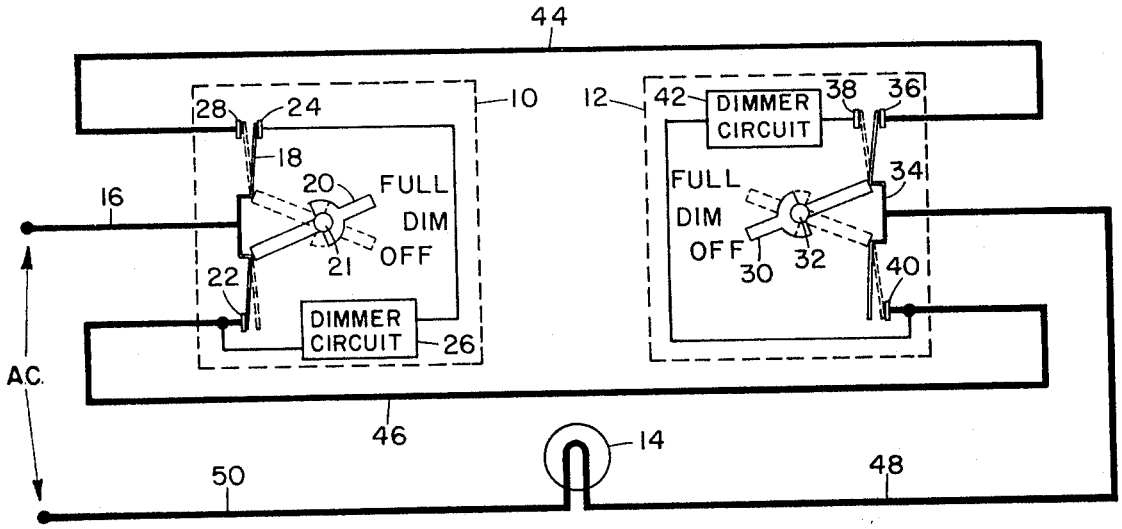
FIG. 1 is a pictorial schematic diagram showing internal connection of three-way light dimmer switches for three-way light dimming capability.

Referring to FIG. 1 of the drawings, there is shown an illustrative schematic diagram of a three-way connection between vertically actuated light dimmer switches 10 and 12 for giving three-way light dimming capability to lamp 14. Input line 16 for standard AC voltage is connected to contactor arm 18 of light dimmer switch 10. In the position as shown, the vertically actuated lever arm 20 which operates about pivot 21 has depressed one end of the actuator arm into electrical contact with normally opened (NO) contact 22. The opposite end of the contactor arm 18 is in electrical contact with normally closed (NC) contact 24. Both the NO contact 22 and the NC contact 24 are electrically connected to dimmer circuit 26. If the vertically actuated lever arm 20 is moved to the OFF position as illustrated in dotted lines, one end of the contactor arm 18 will break its electrical connection with NO contact 22, and the opposite end of the contactor arm 18 will break its electrical connection with NC contact 24 and make an electrical connection with NO contact 28.

Referring to light dimmer switch 12, when the vertically actuated lever arm 30 has pivoted about pivot point 32 to the position as shown, contactor arm 34 will be depressed on one end thereby making an electrical connection with NO contact 36. Upon moving the lever arm 30 to the full ON position as represented in dotted lines, one end of the contactor arm 34 will be released thereby breaking the electrical connection with NO contact 36 and making an electrical connection with NC contact 38. Simultaneously, the opposite end of the contactor arm 34 will make an electrical connection with NO contact 40. Both the NC contact 38 and the NO contact 40 connect to the dimmer circuit 42.

Interconnection between the two light dimmer switches 10 and 12 is provided by wires 44 and 46. One end of wire 44 connects to NO contact 28 of switch 10, and the opposite end of wire 44 connects to NO contact 36 of switch 12. One end of wire 46 connects to NO contact 22 of switch 10, and the opposite end of wire 46 connects to NO contact 40 of switch 12. Light dimmer switch 12 is connected to lamp 14 by means of wire 48 connected to contactor arm 34. Thereafter, lamp 14 is connected to the AC input voltage via wire 50.

Figure 3:
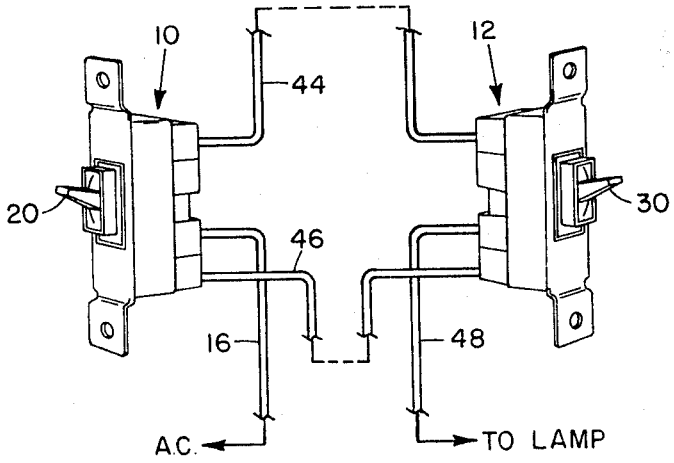
FIG. 3 is a pictorial representation of each three-way light dimming switch as interconnected to household wiring.

Referring now to FIG. 3, the interconnection between light dimmer switches 10 and 12 is illustrated pictorially. Wires 44 and 46 connect between the switches 10 and 12. Wire 16 connects to the AC input voltage and wire 48 connects to the lamp 14.

Figure 2:
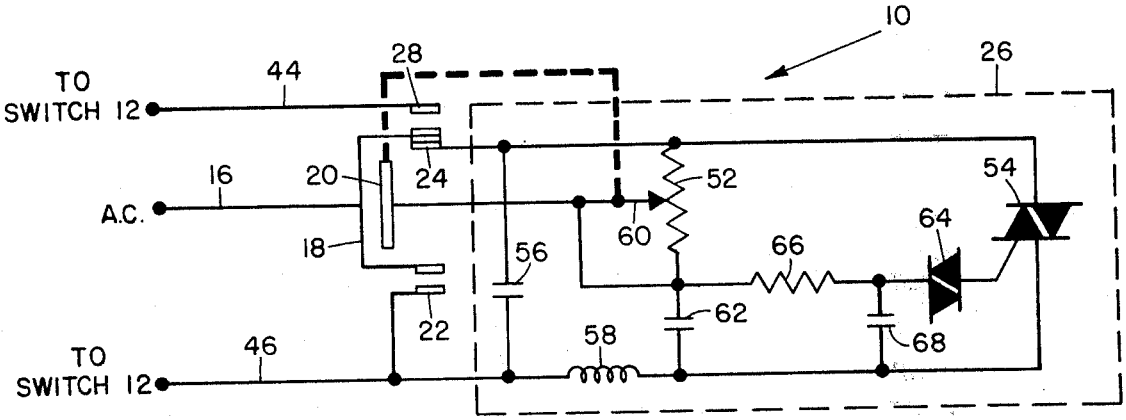
FIG. 2 is a detail schematic diagram of a three-way light dimming switch.

Referring now to FIG. 2 of the drawings, there is shown a detail schematic diagram for either light dimmer switch 10 or 12. For the purposes of illustration only, light dimmer switch 10 has been selected for detail schematic representation in FIG. 2. Like numerals as previously used will be used in conjunction with the description of FIG. 2. The actuator arm 20 is in the DIM position thereby allowing current flow through dimmer circuit 26. It should be realized that the actuator arm 20 as functionally shown in FIG. 2 is nonconductive. Also, wire 50 for the second AC input lead is not shown in FIG. 2.

The AC input voltage is fed through contactor arm 18 and NO contact 24 to variable resistor 52, triac 54 and capacitor 56. The triac 54 is connected in series with inductor 58, which connects through switch 12 to the AC input voltage. The charge on capacitor 56 approximately follows the AC input voltage.

As the lever arm 20 is varied between the FULL position and the OFF position, the position of the wiper arm 60 of variable resistor 52 is also varied. As the position of the wiper arm 60 varies toward the FULL position of the lever arm 20, charge on capacitor 62 is increased. As the charge on capacitor 62 increases, the voltage across diac 64 also increases. When the limit voltage, either positive or negative, of diac 64 is exceeded, diac 64 will trigger conduction of triac 54. By controlling the trigger point of diac 64 with variable resistor 52, the conduction of triac 54 can also be controlled. The RC circuit formed by resistor 66 and capacitor 68 provides a phase shift and a time delay in the triggering of diac 64.

By movement of lever arm 20 to its uppermost position as shown in FIG. 2, contactor arm 18 will break its electrical connection with NO contact 24 and make an electrical connection with NO contact 28 which will thereby remove dimmer circuit 26 from the three-way circuit as explained in conjunction with FIG. 1. Such a position for lever arm 20 has been designated the OFF position. By moving the lever arm 20 to its lowermost position as shown in FIG. 2, contactor arm 18 will make an electrical connection with NO contact 22 thereby shorting out or bypassing the dimmer circuit 26. Such a position for the lever arm 20 has been designated the FULL position.

As a preferred embodiment, assuming that switch 12 is in the OFF position as shown in FIG. 1, then light dimmer switch 10 may either dim lamp 14 or turn lamp 14 to the FULL position by contactor arm 18 making an electrical connection with NO contact 22. Likewise, switch 10 may turn OFF the lamp 14 by the lever arm 20 moving contactor arm 18 to break the electrical connection with NC contact 24 and make an electrical connection with NO contact 28.

As an alternative embodiment, if light dimmer switch 12 is in the FULL position as shown in dotted lines in FIG. 1, again, switch 10 may either turn lamp 14 ON or OFF, or dim lamp 14. However, if switch 12 is in the DIM position, then switch 10 must be in either the OFF or FULL position for lamp 14 to illuminate at the particular brightness set by dimmer circuit 42.

I claim:

1. A three-way switching circuit for varying power received by a load comprising:

first switching means having a first power limiting circuit therein, said first switching means including a first contactor arm mounted therein actuated at first and second limit positions of a first arcuately moveable control, said actuation of said first contactor arm by said first arcuately moveable control changing electrical connections between said first contactor arm and said first power limiting circuit, said first contactor arm being connected to a first side of a voltage source;

second switching means having a second power limiting circuit therein, said second switching means including a second contactor arm mounted therein actuated at third and fourth limit positions of a second arcuately moveable control, said actuation of said second contactor arm by said second arcuately moveable control changing electrical connections between said second contactor arm and said second power limiting circuit, said load being connected in series with a second side of said voltage source and said second contactor arm;

first connecting means electrically connecting said first power limiting circuit to said second power limiting circuit;

second connecting means for electrically connecting either of said first and second power limiting circuits through said first contactor arm to said first side of said voltage source and through said second contactor arm to said load to vary power received by said load, both said first and second switching means being independently operable to cause said variation of power.

2. The three-way circuit as given in claim 1 wherein said second connecting means includes third and fourth switching means having at least single pole, double-throw capabilities in said first and second switching means, respectively, said first and second contactor arms operating said third and fourth switching means, respectively.

3. The three-way circuit as given in claim 2 wherein said first and second contactor arms form fifth and sixth switching means having at least single pole, single-throw capabilities in said first and second switching means, respectively, for operatively connecting with said first connecting means.

4. The three-way circuit as given in claim 3 wherein a first end of said first and second contactor arms operates said fifth and sixth switching means, respectively; and a second end of said first and second contactor arms operate said third and fourth switching means, respectively; said first and second contactor arms operating in response to movement of said first and second arcuately moveable controls, respectively.

* * * * *